US005392907A

United States Patent [19]

Blanchard et al.

[11] Patent Number: 5,392,907

[45] Date of Patent: Feb. 28, 1995

[54] GOLF CLUB SEPARATING INSERT

[76] Inventors: Andrew F. Blanchard, 909 Dimrock, Schertz, Tex. 78154; Rodney R. Boerm, 301 S. Archer #3A, Beeville, Tex. 78102

[21] Appl. No.: 156,002

[22] Filed: Nov. 22, 1993

[51] Int. Cl.[6] ..... A63B 55/04

[52] U.S. Cl. ..... 206/315.6; 206/315.3

[58] Field of Search ..... 206/315.3, 315.6, 315.4, 206/315.1

[56] References Cited

U.S. PATENT DOCUMENTS

| | | | |
|---|---|---|---|
| 2,023,792 | 12/1935 | Sampson . | |
| 2,722,258 | 11/1955 | Smidt et al. . | |
| 3,101,108 | 8/1963 | Ingeldt . | |
| 4,172,484 | 10/1979 | Henning | 206/315.6 |
| 4,311,178 | 1/1982 | Kennedy | 206/315.6 |
| 4,664,382 | 5/1987 | Palmer et al. | 206/315.6 X |
| 4,685,561 | 8/1987 | Reimers | 206/317.7 X |
| 4,881,638 | 11/1989 | Cho | 206/315.5 X |
| 4,938,349 | 7/1990 | Burns | 206/315.6 |
| 4,995,510 | 2/1991 | Fletcher, Jr. | 206/315.6 |
| 5,088,600 | 2/1992 | Kopp, Jr. | 206/315.6 X |
| 5,125,507 | 6/1992 | Graziano, Jr. | 206/315.6 |
| 5,255,781 | 10/1993 | Dulyea, Sr. | 206/315.3 X |

*Primary Examiner*—Allan N. Shoap
*Assistant Examiner*—Christopher J. McDonald
*Attorney, Agent, or Firm*—Novak, Vickers & Burt

[57] ABSTRACT

A golf bag insert and a method for manufacturing the same, the insert comprised of a plurality of elongated six-sided cells attached to each other in configurations that maximize space and minimize mass resulting in a lighter weight insert. Each golf club has its own individual elongated six-sided cell which eliminates entanglement of clubs and limits damage to golf club shafts and grips. The method of manufacturing consists of producing, positioning and attaching a plurality of modular units to form an insert comprised of a plurality of elongated six-sided cells.

4 Claims, 2 Drawing Sheets

GOLF CLUB SEPARATING INSERT

BACKGROUND OF THE INVENTION

1) Field of the Invention

The present invention relates to golf equipment, and more particularly to golf bag inserts for use in a variety of golf bags.

2) Background Art

In this era when the sport of golf predominates throughout every level of our society, golf equipment must be able to meet the desires and specifications of each individual golfer. Golf has become the primary recreational activity of many Americans: young and old; men and women; rich and middle class; and therefore, golf equipment must meet the individual needs of all these different consumers.

The golf industry has met these needs by providing equipment in every specification and price range. The most important equipment, golf clubs, have become a major investment for many, and are purchased to conform to the individual golfer's needs. With the ever increasing expense of golf clubs, the individual golfer demands appropriate protection for these valuable clubs. As the material composition of golf club shafts becomes lighter and stronger, but more susceptible to damage, the necessity for isolating each individual club from each other club takes on a greater importance than at any other time in golf history. While in a golf bag, each individual club must be treated as if it were the only club in the bag to eliminate damaging entanglements with other golf clubs. The golf club must also be prevented from any significant lateral movement to protect against damage from other clubs. The golf club must also be enclosed in the golf bag in a manner that will not damage the golf club's shaft and grip during retrieval and replacement of the club in the bag. And finally, the golf clubs must be positioned in an organized manner to effectuate location of the proper club for ease in retrieval and replacement without removal of excess clubs.

The golf industry has failed in their attempts to meet the problems associated with protecting expensive golf clubs with steel or graphite shafts in a simple, universal manner. Previously, some golf bags were partitioned in such a manner which isolated only the individual heads of golf clubs. Other golf bags were structured to provide full length dividers for golf clubs from the grip end to the head of the club. However, the singular concept of these golf bags was to provide retrieval and replacement ease which was not accomplished, and the singular concept of these golf bags failed to consider substantive ways in which to protect the individual golf club itself while maintaining good utilization of a defined space. These and other golf bag interior structures also failed to limit lateral movement and failed to efficiently utilize space and weight. Still others used individual round tubes for each golf club which resulted in excessively heavy golf bags and poor utilization of space.

Today's golfer demands protection for their clubs in a manner that not only isolates the individual golf clubs from each other, but stabilizes and protects the club while in the bag, prevents substantial lateral movement, does not significantly increase the weight of the golf bag, meets the individual golfer's arrangement methods, and provides ease of locating, retrieving and replacing golf clubs. Until the advent of the present invention, these demands were unsatisfied.

SUMMARY OF THE INVENTION

The unsatisfied demands of today's golfer are met by the present invention which encompasses a golf bag separating insert and a method for manufacturing the golf bag separating insert in various configurations for utilization in all types of golf bags. The present invention utilizes six-sided elongated cells to create individual chambers for each individual golf club. The six-sided cells isolate and protect the individual golf club from the other clubs in the golf bag while limiting their lateral movement to provide less head contact. The six-sided cell shape allows for multiple configurations resulting in various bag designs, providing exceptional space utilization and enabling the individual golfer to choose a bag design that accommodates his preference of clubs.

The method of manufacturing the golf club separating insert allows for efficient use of materials and creates a light weight insert. The six-sided shape provides an effective building block for manufacturing inserts in various configurations to accommodate the individual golfer. Any particular configuration can be created by adding, deleting or rearranging the six-sided cells. The preferred method of manufacture creates modular units of one, two or three six-sided cells for assembly, but units of any number of six-sided cells can be constructed for assembly into a golf club separating insert.

It is an object of the present invention to provide a golf club separating insert that isolates and protects individual golf club shafts and grips from damage when positioned in a golf bag.

A further object of this invention is to provide a golf club separating insert that limits the lateral movement of a golf club in order to limit head contact.

A further object of this invention is to provide a light weight golf club separating insert that efficiently utilizes the defined space of a golf bag.

A further object of this invention is to provide a method for manufacturing golf club separating inserts of any configuration or design.

Other objects of the present invention will become apparent from the detailed description of the invention.

DETAILED DESCRIPTION OF THE INVENTION

Figure 1:
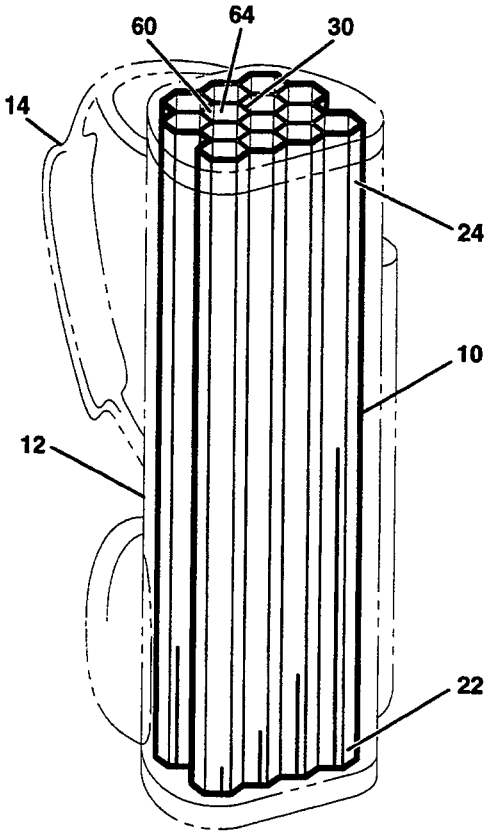
FIG. 1 is perspective view of the present invention in conjunction with a golf bag.
Figure 2:
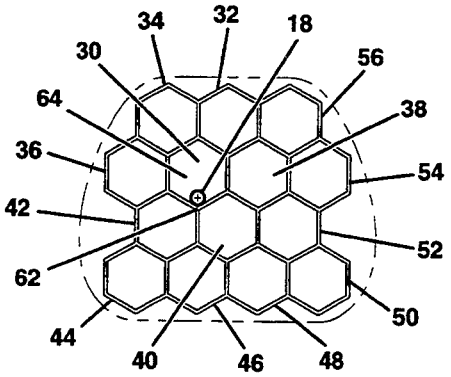
FIG. 2 is a top view of the present invention.
Figure 4A:
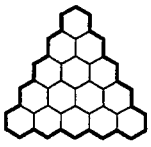
FIGS. 4A–4J are top views of various configurations of the present invention.
Figure 4B:
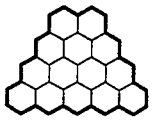
Figure 4C:
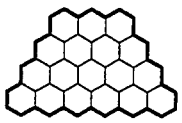
Figure 4D:
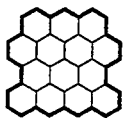
Figure 4E:
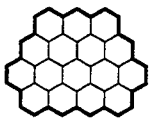
Figure 4F:
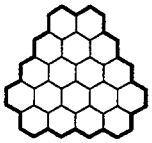
Figure 4G:
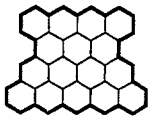
Figure 4H:
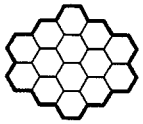
Figure 4I:
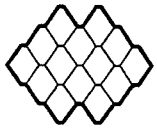
Figure 4J:
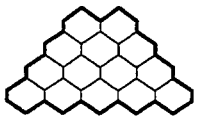

Referring to FIG. 1 and FIG. 2, the golf club separating insert 10 includes a plurality of elongated six-sided cells 30–56 attached to each other in an insert configuration suitable for insertion into a golf bag 12. The insert 10 has an upper end 24 which extends from its vertical midpoint to the open end of the golf bag 12, and a lower end 22 which extends from the vertical midpoint to the closed end of the golf bag 12.

The individual six-sided cell 30 epitomizes the plurality of six-sided cells. The cell sides and/or vertices of any six-sided cell, including six-sided cell 30, can be categorized as top, center and bottom. The top sides or vertices are nearest the carrying strap 14 of the golf bag 12, the center sides or vertices are between the top and the bottom, and the bottom sides or vertices are opposite the top. Each individual six-sided cell 30–56 has an aperture for receiving and retrieving a golf club, as exemplified by aperture 64 located on the upper end of six-sided cell 30. Each individual six-sided cell 30–56 has a hollow interior for isolating and stabilizing an individual golf club, as exemplified by hollow interior 60 of the six-sided cell 30.

The insert 10 is comprised of a collection of six-sided cells attached to each other in a manner that maximizes the defined space of a golf bag 12. The insert 10 could be configured to accommodate many different golf bag shapes and designs depending on the number of golf clubs. The nature of the six-sided cell shape itself is structurally a very effective building block for a golf club separating insert. The six-sided cell shape allows for the defined space of a golf bag to be maximized while the mass of the insert is minimized.

The effectiveness of the six-sided cell shape is illustrated in FIG. 2 through the positioning arrangement of six-sided cell 30 and its surrounding six-sided cells 32–42. The top right side of cell 30 is attached to the bottom left side of cell 32. The top left side of cell 30 is attached to the bottom right side of cell 34. The center left side of cell 30 is attached to the center right side of cell 36. The center right side of cell 30 is attached to the center left side of cell 38. The bottom right side of cell 30 is attached to the upper left side of cell 40. The bottom left side of cell 30 is attached to the upper right side of cell 42. This basic format of positioning is repeated throughout the plurality of cells 30–56 providing for an insert 10 in which total space is maximized and total mass is minimized resulting in a lighter weight insert 10. The insert 10 is composed of a rigid, resilient and light weight material. Although plastic is the preferred material, nylon, leather and other plastic like polymers can be utilized in constructing the insert. The nature of the six-sided cell shape allows for the addition or subtraction of six-sided cells to create an insert that can accommodate a greater or lesser number of golf clubs and still maximize space and minimize mass.

In FIG. 1, the plurality of cells 30–56 comprising the insert 10 are equal in vertical length. However, other embodiments of the present invention could have the upper or lower end of the insert 10 cut at an angle depending on each individual golf bag design. In FIGS. 1 and 2, the plurality of six-sided cells 30–56 are equal in horizontal width. However, other embodiments of the present invention could have the plurality of six-sided cells 30–56 with unequal horizontal widths, as shown in FIG. 4, configurations 88 and 90, depending on each individual golf bag design.

Figure 3:
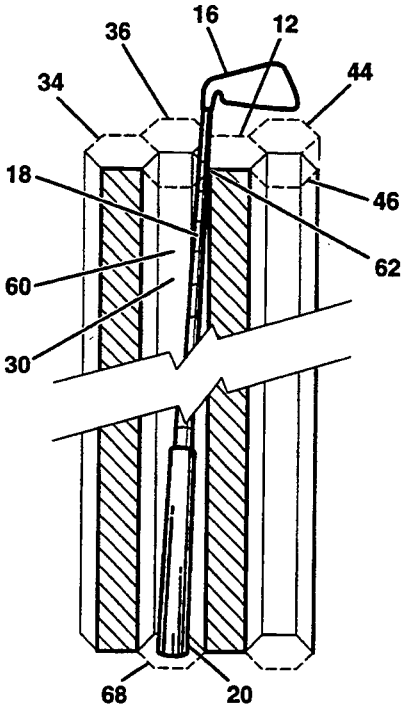
FIG. 3 is side view of a cross section of FIG. 2.

FIG. 3 depicts a cross section of FIG. 2 showing the insert 10 with golf club 16 placed in the hollow interior 60 of the six-sided cell 30. The golf club shaft 18 rest in the vertices 62 which is located at the bottom of aperture 64 of the six-sided cell 30, and which limits lateral movement of the club 16 resulting in a decrease in head contact. The golf club grip 20 is positioned at the lower end of the hollow interior 60 of the six-sided cell 30 and rest atop of the closed end of golf bag 12. The lower end of six-sided cell 30 has an aperture 68 which allows the grip 20 to sit atop of the closed end of golf bag 12. All of the six-sided cells 30–56 have apertures located at the lower end of each six-sided cell 30–56 which minimizes the mass of the insert 10 and thus lowers its weight. However, other embodiments of the present invention could be constructed without an aperture at the lower end.

In FIG. 1, the hollow interior of each six-sided cell is shaped to correspond to the shape of each six-sided cell as exemplified by hollow interior 60. However, the hollow interior could be any number of shapes such as circular, diamond, square, triangular or any polygonal shape. By having the hollow interior 60 corresponding to the six-sided cell shape, the mass of the insert 10 is minimized allowing for a light weight insert 10. The hollow interior 60 is constructed to isolate the individual golf club from other golf clubs and to ensure ease of retrieval and replacement. By having the side walls of each individual six-sided cell 30–56 extend the length of the insert 10, golf clubs are prevented from becoming entangled with each other and damage to expensive golf club shafts made of graphite or steel, including their grips, is limited.

FIGS. 4A–4J illustrate some of the many different configurations 72–90 that can be arranged using the plurality of six-sided cells attached to one another. A golf bag would be shaped and designed to encompass the insert itself, and an insert could be configured to fit within a golf bag already available. Although the configurations 72–90 only consist of fourteen to eighteen six-sided cells, the insert can be arranged to accommodate any individual golfer's preferences whether a greater or lesser number of six-sided cells are needed. The same principles of space and mass efficiency are used in all the assembled configurations of the insert 72–90 since a six-sided cell is the essential building block of all possible configurations.

Figure 5A:
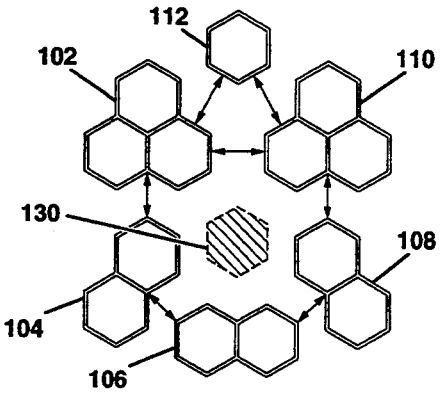
FIGS. 5A and 5B are exploded and assembly drawings of the preferred method of manufacturing the present invention.
Figure 5B:
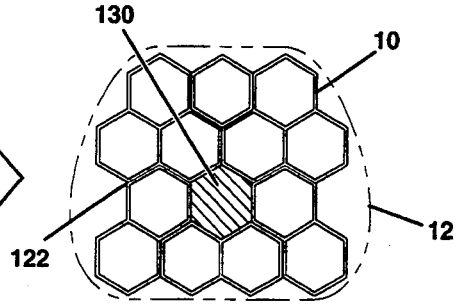

FIGS. 5A and 5B illustrates the preferred method of manufacturing the present invention. In FIG. 5A, a plurality of modular units 102–112 are positioned in a pre-insert configuration. The modular units 102–112 are produced through an extrusion process which results in modular units consisting of sets of one, two and three six-sided cells. Sets of a greater number of six-sided cells are possible through an extrusion process, not shown, but the preferred method only uses the one, two and three six-sided celled modular units.

Modular unit 102 is an example of a three six-sided celled modular unit produced through an extrusion process. Modular units 104 and 112 are examples of two and one six-sided celled modular units, respectively, also produced through an extrusion process. In the multiple six-sided celled modular units like 102 and 104, the six-sided cells share a single adjoining wall providing for efficiency in space and mass of the modular units which results in a lighter weight insert 10.

After the modular units 102–112 are positioned in an insert configuration as shown in FIG. 5*a*, they are attached to each other resulting in the insert configuration shown in FIG. 5*b*. Where the side walls of one modular unit are adjoined to the side walls of another modular unit, a double wall is formed, as exemplified by double wall 122. This double wall 122 results in a common wall shared by two adjoined six-sided cells which increases the thickness of that particular side wall. The double walls will exist wherever two different modular units are adjoined. Other embodiments of the present invention could have six-sided cells with all singular walls if extruded in one unit form, resulting in thinner walls and a lighter insert.

The preferred method of attaching the modular units is through a chemical bonding process, but other methods such as a heating process could be used in producing the needed results. The adjoining walls of the assembled and bonded modular units result in a rigid and resilient insert 10.

In various configurations such as FIG. 5*b*, a phantom cell 130 is created by the adjoining of six six-sided cells resulting in efficiency of space and mass. In other configurations, not shown, a greater number of phantom cells will be present.

Figure 6A:
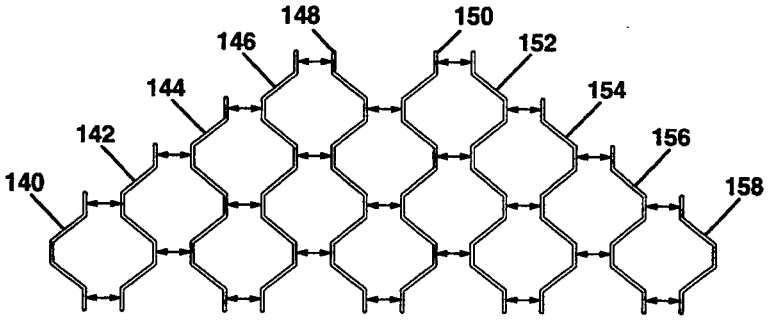
FIGS. 6A and 6B are exploded and assembly drawings of a method of manufacturing the present invention.
Figure 6B:
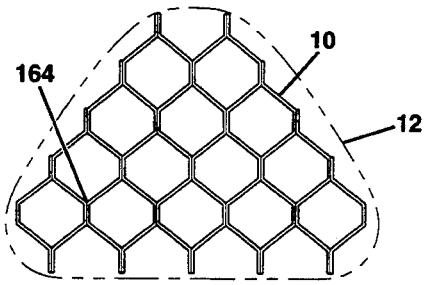

The FIG. 5 insert configuration consist of fourteen six-sided cells matching the number of golf clubs allowed by the Professional Golfers Association. However, the insert could be configured to accommodate a greater or lesser number of clubs. This would be accomplished by the addition or subtraction of modular units corresponding to the number of clubs above or below fourteen. FIGS. 6A and 6B illustrate a method of manufacturing the present invention. In FIG. 6*a*, a plurality of modular units 140–158 are positioned in an insert configuration. The modular units 140–158 are corrugated pieces bent to form six-sided cells when attached to each other as shown in FIG. 6*b*. The six-sided cells formed by the assembly of the modular units 140–158 are consistent in size and shape. The modular units 140–158 vary in the number of folds depending on the position of the modular unit 140–158 in the insert configuration.

Figure 7A:
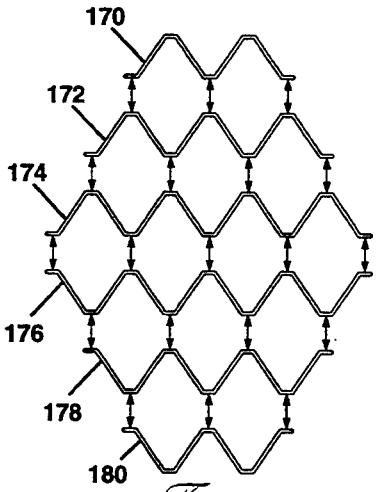
FIGS. 7A and 7B are exploded and assembly drawings of a method of manufacturing the present invention.
Figure 7B:
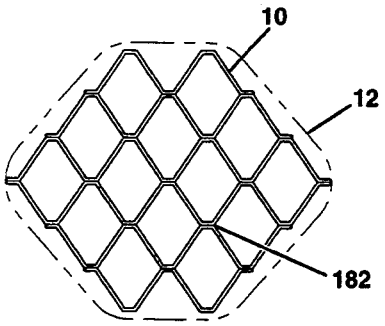

In FIGS. 6B and 7B, the preferred method of attachment is through a chemical bonding process. However, other attachment processes such as heating processes may be used to produce the needed results. The adjoining walls of the assembled and bonded modular units provide a rigid and resilient insert. Where the side walls of one modular units are attached to another modular unit, a double wall is formed as exemplified by double wall 164 which is formed by the attachment of modular unit 142 to modular unit 144. This double wall results in a common wall shared by two six-sided cells and increases the thickness of that particular wall.

FIG. 6*b* shows the attached insert configuration having fourteen six-sided cells matching the number of clubs allowed by the Professional Golfers Association. Other configurations, not shown, can be constructed through attaching modular units to form a greater or lesser number of six-sided cells. This is accomplished by increasing or decreasing the number of folds in the corrugated pieces, or adding or subtracting the number of modular units.

FIGS. 7A and 7B illustrate is a method of manufacturing the present invention. In FIG. 7A as in FIG. 6B, the modular units 170–180 are corrugated pieces which form six-sided cells when attached to each other. The modular units 170–180 vary in the number of folds but when attached result in six-sided cells that are consistent in size and shape. When the modular units 170–180 are attached, double walls are formed as exemplified by double wall 182. This double wall results in a common wall shared by two six-sided cells and will act as the resting place for a golf club's shaft, not shown, if this is the bottom side of a six-sided cell. As in FIG. 6A, the number of six-side cells can be increased or decreased, resulting in various golf bag designs.

The embodiments of the invention in which an exclusive property or privilege is claimed are defined as follows:

1. A golf club separator for a golf bag, comprising:

a unitized golf club separating insert for installation into a golf bag for receiving and retaining golf clubs;

said club separating insert comprising a plurality of individual six-sided cells, each of said cells being joined to at least one other cell at exterior surfaces of sides of said cells in face-to-face abutment, thereby forming the unitized club separating insert for accommodating a plurality of golf clubs, one each within said cells;

each of said individual cells having an upper end and a lower end and an aperture for providing access into each cell and that is located proximate said upper end of said cell for receiving a single golf club therein;

vertices located proximate at bottom of said aperture for engaging and limiting the lateral movement of a shaft of the golf club;

said sides of said cell extending continuously between said upper and lower ends of said cells thereby preventing club-to-club contact within said separating insert; and said cells being constructed from a material sufficiently rigid to be self supporting.

2. The golf club separator for a golf bag as recited in claim 1, further comprising:

said rigid construction material being plastic.

3. The golf club separator for a golf bag as recited in claims 2 further comprising:

said cells being configured and joined together so as to conform to an interior of the golf bag when inserted therein.

4. The golf club separator for a golf bag as recited in claim 3, further comprising:

top sides of each cell are nearest a carrying strap of the golf bag.

* * * * *